US010689789B2

(12) United States Patent
Lee et al.

(10) Patent No.: US 10,689,789 B2
(45) Date of Patent: Jun. 23, 2020

(54) LAUNDRY TREATMENT APPARATUS

(71) Applicant: LG Electronics Inc., Seoul (KR)

(72) Inventors: Jihong Lee, Seoul (KR); Hoon Choi, Seoul (KR); Hoonseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 291 days.

(21) Appl. No.: 15/555,294

(22) PCT Filed: Feb. 29, 2016

(86) PCT No.: PCT/KR2016/001985
§ 371 (c)(1),
(2) Date: Sep. 1, 2017

(87) PCT Pub. No.: WO2016/140472
PCT Pub. Date: Sep. 9, 2016

(65) Prior Publication Data

US 2018/0347098 A1 Dec. 6, 2018

(30) Foreign Application Priority Data

Feb. 29, 2016 (KR) ..... 10-2015-0028982

(51) Int. Cl.
*D06F 33/02* (2006.01)
*D06F 37/42* (2006.01)
(Continued)

(52) U.S. Cl.
CPC ..... *D06F 37/42* (2013.01); *D06F 33/02* (2013.01); *D06F 39/085* (2013.01);
(Continued)

(58) Field of Classification Search
CPC ..... D06F 33/02
See application file for complete search history.

(56) References Cited

U.S. PATENT DOCUMENTS

| | | | |
|---|---|---|---|
| 3,857,002 | A | 12/1974 | Lay et al. |
| 2002/0042957 | A1 | 4/2002 | Kim et al. |
| 2009/0145175 | A1 | 6/2009 | Kim et al. |

FOREIGN PATENT DOCUMENTS

| | | |
|---|---|---|
| EP | 2949803 | 12/2015 |
| GB | 2444933 | 6/2008 |

(Continued)

OTHER PUBLICATIONS

International Search Report and Written Opinion in International Application No. PCT/KR2016/001985, dated May 18, 2016, 19 pages (with English translation).

(Continued)

*Primary Examiner* — Jason Y Ko
(74) *Attorney, Agent, or Firm* — Fish & Richardson P.C.

(57) ABSTRACT

A laundry treatment apparatus includes a drawer. The laundry treatment apparatus further includes a cabinet that is configured to receive the drawer. The laundry treatment apparatus further includes an introduction port that is located in an upper surface of the drawer. The laundry treatment apparatus further includes a drum that is located in the drawer and that is configured to communicate with the introduction port. The laundry treatment apparatus further includes a driving shaft that is located at a bottom surface of the drum. The laundry treatment apparatus further includes a driving unit that is configured to rotate the driving shaft. The laundry treatment apparatus further includes a controller that is configured to control the driving unit. The laundry treatment apparatus further includes an attachment and detachment unit that is configured to connect the drawer to the cabinet in response to a control signal from the controller.

21 Claims, 4 Drawing Sheets

(51) Int. Cl.

| | |
|---|---|
| ***D06F 58/28*** | (2006.01) |
| ***D06F 39/08*** | (2006.01) |
| *D06F 58/20* | (2006.01) |
| *D06F 37/22* | (2006.01) |
| *D06F 31/00* | (2006.01) |
| *D06F 37/24* | (2006.01) |
| *D06F 39/12* | (2006.01) |
| *D06F 37/28* | (2006.01) |
| *D06F 39/14* | (2006.01) |

(52) U.S. Cl.

CPC ..... *D06F 39/088* (2013.01); *D06F 58/28* (2013.01); *D06F 31/00* (2013.01); *D06F 37/22* (2013.01); *D06F 37/24* (2013.01); *D06F 37/28* (2013.01); *D06F 39/125* (2013.01); *D06F 39/14* (2013.01); *D06F 58/20* (2013.01); *D06F 2202/12* (2013.01); *D06F 2204/06* (2013.01); *D06F 2204/084* (2013.01); *D06F 2204/086* (2013.01); *D06F 2204/10* (2013.01); *D06F 2210/00* (2013.01)

(56) References Cited

FOREIGN PATENT DOCUMENTS

| | | |
|---|---|---|
| KR | 10-2008-0065752 | 7/2008 |
| KR | 10-2009-0057791 | 6/2009 |
| KR | 10-2014-0094056 | 7/2014 |
| WO | 2008/084934 | 7/2008 |

OTHER PUBLICATIONS

Supplementary European Search Report in European Application No. 16759108.0, dated Oct. 25, 2018, 8 pages.

[Fig. 1]
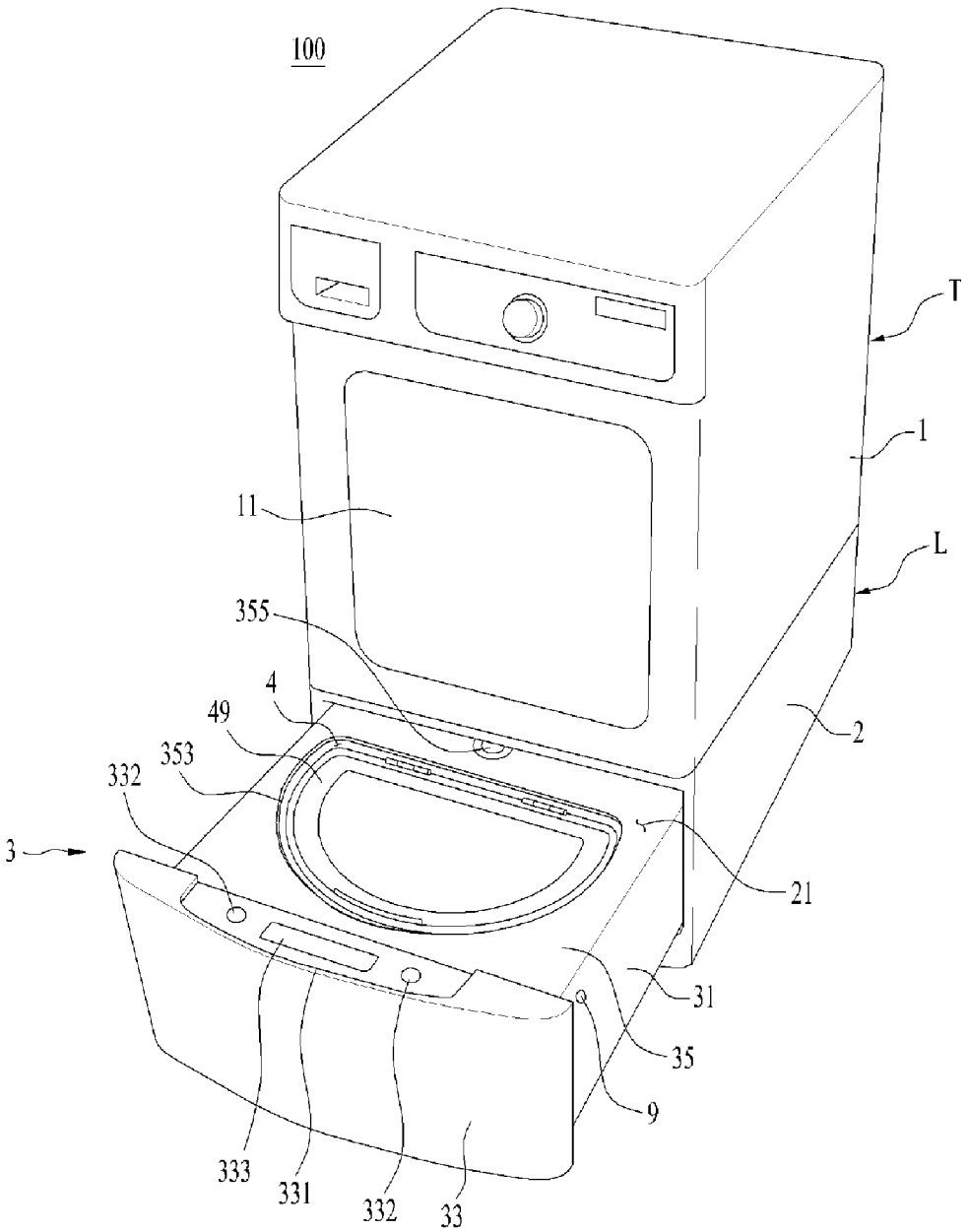

[Fig. 2]
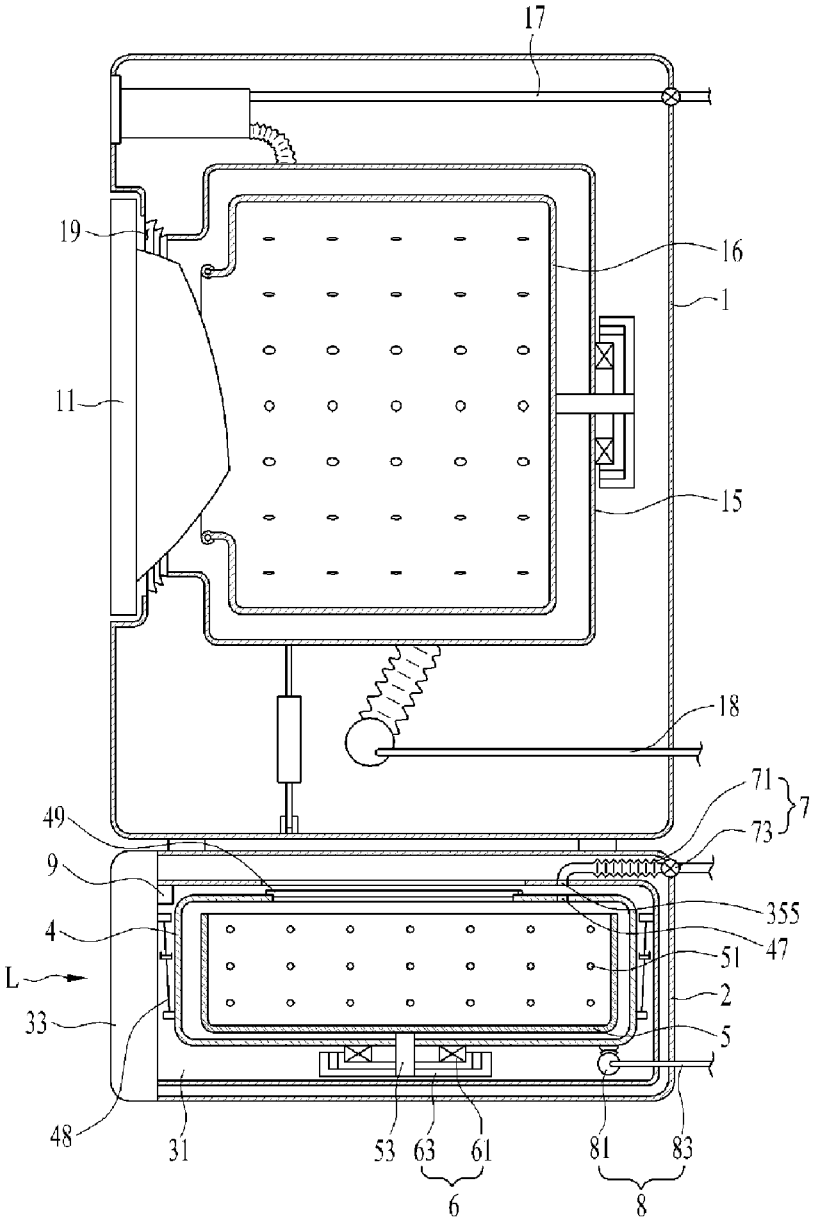

[Fig. 3]
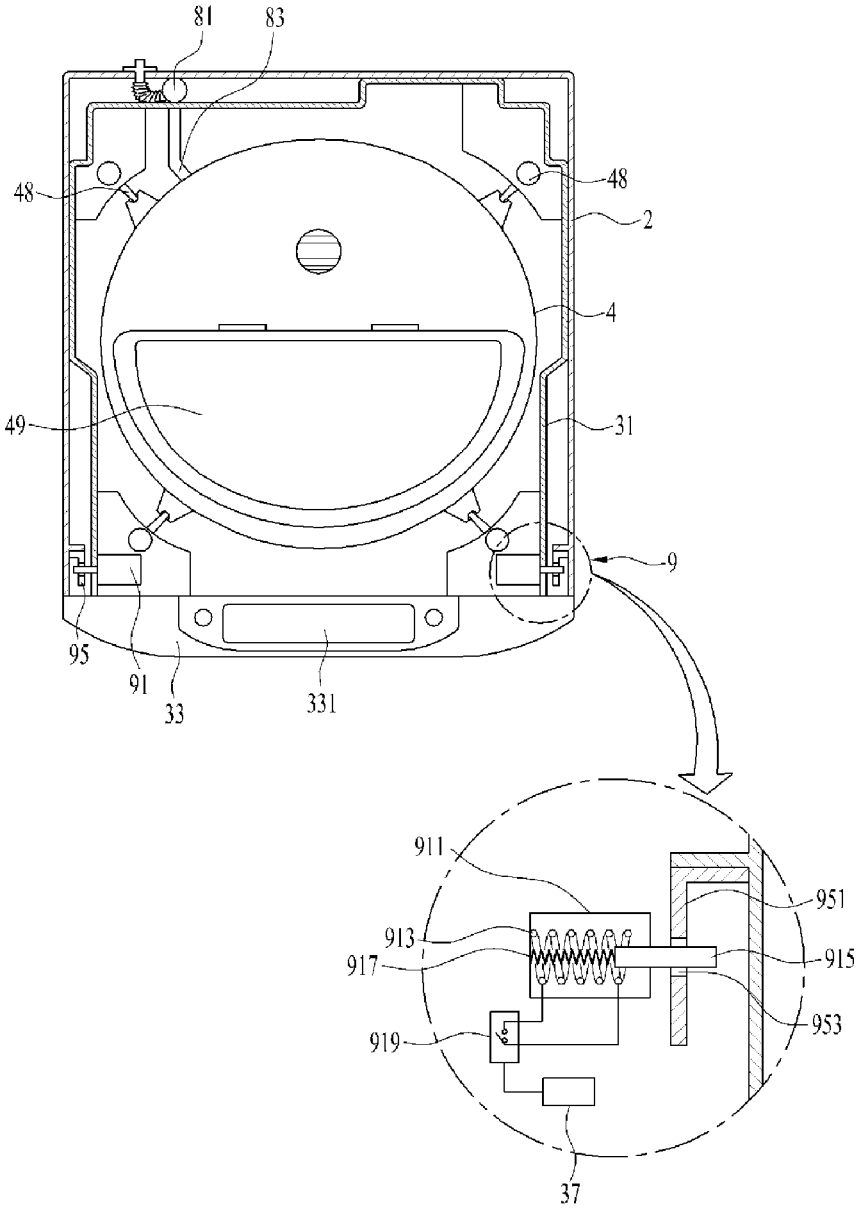

[Fig. 4]
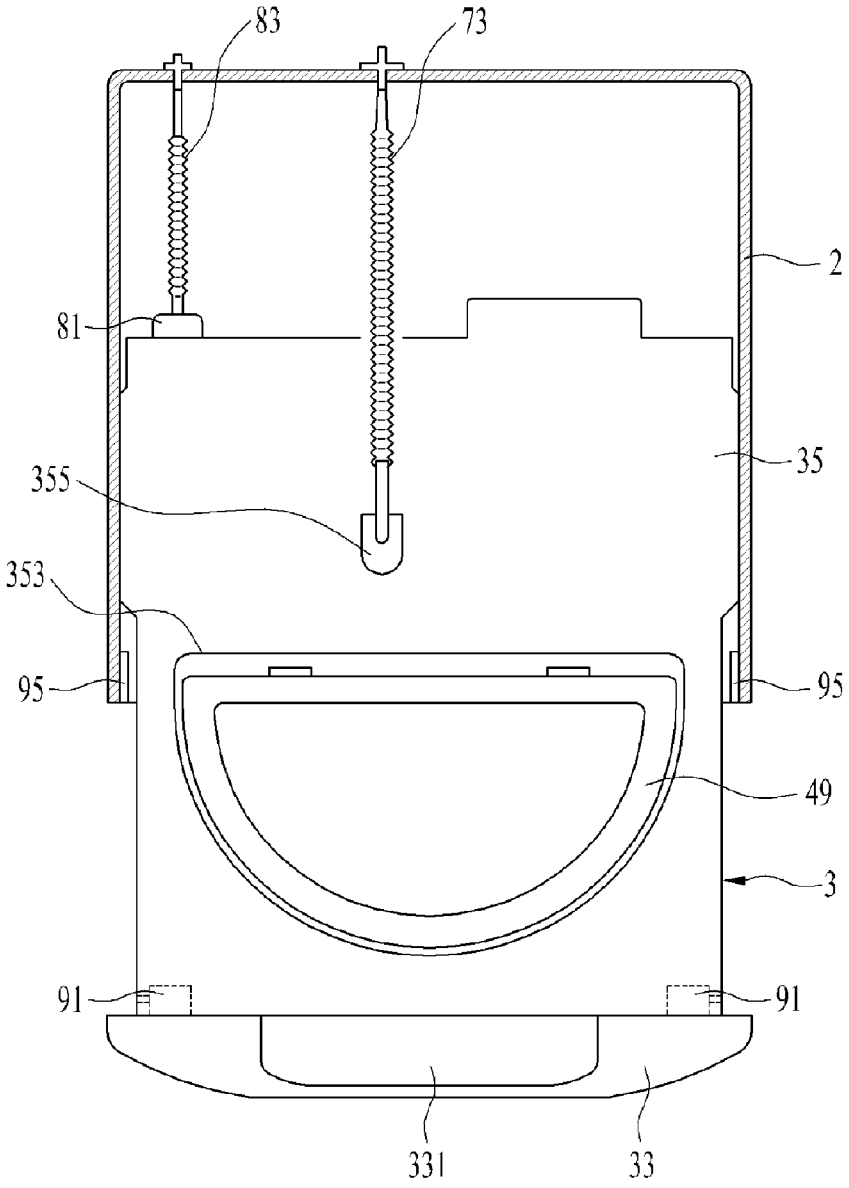

LAUNDRY TREATMENT APPARATUS

CROSS-REFERENCE TO RELATED APPLICATIONS

This application is the National Phase of PCT International Application No. PCT/KR2016/001985, filed on Feb. 29, 2016, which claims priority under 35 U.S.C. 119(a) to Korean Patent Application No. 10-2015-0028982, filed on Mar. 2, 2015. The disclosures of the prior applications are incorporated by reference in their entirety.

TECHNICAL FIELD

The present disclosure relates to a laundry treatment apparatus.

BACKGROUND ART

In general, a laundry treatment apparatus is a concept including an apparatus for washing laundry (objects to be washed), an apparatus for drying laundry (objects to be dried), and an apparatus for washing and drying laundry (objects to be washed and objects to be dried).

In a front loading type laundry treatment apparatus (for example, a drum type washing machine), in which laundry is introduced into the laundry treatment apparatus through the front thereof, an introduction port, through which laundry is introduced into the laundry treatment apparatus, is lower than the waist of a user, with the result that the user must stoop to introduce laundry into the laundry treatment apparatus or to remove laundry from the laundry treatment apparatus.

DISCLOSURE OF INVENTION

Technical Problem

An object of the subject matter described in this application lies in a laundry treatment apparatus that is capable of washing or drying laundry using a receiving unit configured to be pulled out from a cabinet.

Another object of the subject matter described in this application lies in a laundry treatment apparatus that is capable of minimizing vibration of a receiving unit in a cabinet while washing or drying laundry.

A further object of the subject matter described in this application lies in a laundry treatment apparatus that is capable of preventing a receiving unit from moving out from a cabinet while washing or drying laundry.

Solution to Problem

According to an innovative aspect of the subject matter described in this application, a laundry treatment apparatus includes: a drawer; a cabinet that is configured to receive the drawer; an introduction port that is located in an upper surface of the drawer; a drum that is located in the drawer, that is configured to communicate with the introduction port, and that defines a laundry receiving space; a driving shaft that is located at a bottom surface of the drum; a driving unit that is configured to rotate the driving shaft; a controller that is configured to control the driving unit; and an attachment and detachment unit that is configured to connect the drawer to the cabinet in response to a control signal from the controller.

The laundry treatment apparatus may include one or more of the following optional features. The attachment and detachment unit is located above the driving unit. The attachment and detachment unit includes: a first fastening unit that is located at the cabinet; and a second fastening unit that is located at the drawer and that is configured to couple to the first fastening unit in response to the control signal from the controller. The first fastening unit is located at an inner upper part of the cabinet. The second fastening unit is located at an upper part of the drawer. The first fastening unit is located at a side of an inner circumferential surface of the cabinet. The second fastening unit is located at a side surface of the drawer. An additional first fastening unit is located at the inner upper part of the cabinet. An additional second fastening unit is located at the upper part of the drawer. An additional first fastening unit is located at another side of the inner circumferential surface of the cabinet. An additional second fastening unit is located at another side surface of the drawer. A height of the second fastening unit and a height of an additional second fastening unit are different.

The cabinet includes an open surface that defines an introduction port of the drawer. The drawer includes: a drawer body that defines a space that is configured to receive the drum; and a drawer panel that is separably connected to the drawer body and that is configured to open and close the open surface. The second fastening unit is connected to the drawer body and is visible based on the drawer panel being separated from the drawer body. The laundry treatment apparatus further includes: a tub that is located in the drawer and that is configured to receive the drum; and a door that is located at an upper surface of the tub and that is configured provide access to the drum. The driving unit includes: a rotor that is connected to the driving shaft; and a stator that is located at a lower surface of the tub and that is configured to rotate the stator. The attachment and detachment unit is located above the driving unit. The first fastening unit is located at a side of an inner circumferential surface of the cabinet. The second fastening unit is located at a side surface of the drawer. An additional first fastening unit is located at another side of the inner circumferential surface of the cabinet.

An additional second fastening unit is located at another side surface of the drawer. The second fastening unit includes: a second fastening unit body that is connected to the drawer; a plunger that is located in the second fastening unit body and that is separately coupled to the first fastening unit; an elastic support unit that is configured to couple the plunger to the first fastening unit by moving the plunger toward the first fastening unit; and a coil that is configured to separate the plunger from the first fastening unit in response to current being supplied to the coil. The plunger is configured to engage a support body of the first fastening unit. The support body defines a fastening hole that is configured to receive the plunger. The controller is configured to supply current to the coil. The second fastening unit includes a relay. The relay is configured to connect the drawer to the cabinet in response to the control signal. The laundry treatment apparatus further includes a switch that is configured to open and close in response to a switch control signal from the controller and that is electrically located between the controller and the attachment and detachment unit.

Advantageous Effects of Invention

As is apparent from the above description, the present invention has the effect of providing a laundry treatment apparatus that is capable of washing or drying laundry using a receiving unit configured to be pulled out from a cabinet.

In addition, the present invention has the effect of providing a laundry treatment apparatus that is capable of minimizing vibration of a receiving unit in a cabinet while washing or drying laundry.

Furthermore, the present invention has the effect of providing a laundry treatment apparatus that is capable of preventing a receiving unit from moving out from a cabinet while washing or drying laundry.

BRIEF DESCRIPTION OF DRAWINGS

FIGS. 1 and 2 are views of example laundry treatment apparatus.

FIGS. 3 and 4 are views of example attachment and detachment units that are located in a laundry treatment apparatus.

BEST MODE FOR CARRYING OUT THE INVENTION

FIGS. 1 and 2 illustrate example laundry treatment apparatuses. A laundry treatment apparatus 100 may include only a first treatment device L. In some implementations, as shown in FIG. 1, the laundry treatment apparatus 100 may include a first treatment device L and a second treatment device T. Hereinafter, a laundry treatment apparatus 100 including a first treatment device L and a second treatment device T will be described in detail by way of example for the convenience of description.

The first treatment device L is a device that treats (for example, washes or dries) laundry (objects to be washed or objects to be dried), and the second treatment device T is a device that is separably mounted to the first treatment device L in order to treat laundry.

As shown in FIG. 2, the second treatment device T may include a second cabinet 1 forming the external appearance of the second treatment device T, a second tub 15 provided in the second cabinet 1 for receiving wash water, a second drum 16 rotatably provided in the second tub 15 for providing a laundry receiving space, a second water supply unit 17 for supplying wash water to the second tub 15, and a second drainage unit 18 for discharging wash water received in the second tub 15 out of the second cabinet 1.

The second cabinet 1 is provided with a second treatment device introduction port 19, through which laundry is introduced into or removed from the second treatment device T. The second treatment device introduction port 19 is opened and closed by a second treatment device door 11, which is hingedly coupled to the second cabinet 1.

The second treatment device introduction port 19 communicates with the interior of the second drum 16 through a second tub introduction port, which is provided in the second tub 15, and a second drum introduction port, which is provided in the second drum 16. Consequently, a user may open the second treatment device door 11 in order to introduce laundry into the second drum 16 or to remove the laundry received in the second drum 16 out of the second cabinet 1.

In some implementations, the second treatment device T is configured to have a function of drying laundry in addition to a function of washing laundry, and a second hot air supply device for supplying heated air into the second tub 15 may be further provided in the second cabinet 1.

The second hot air supply device may include a circulation duct for circulating air in the second tub 15 and a heat exchange unit provided in the circulation duct for dehumidifying and heating air discharged from the second tub 15.

In some implementations, the second hot air supply device may include a discharge duct for discharging air in the second tub 15 out of the second cabinet 1, a supply duct for supplying air outside the second cabinet 1 into the second tub 15, and a heat exchange unit provided in the supply duct for heating air that is introduced into the supply duct.

In some implementations, the second treatment device T is configured only to dry laundry, and the second tub 15 may be omitted from the second treatment device T. In some implementations, a member for rotatably supporting the second drum 16 may be further provided in the second treatment device T. In addition, the second hot air supply device may be configured to supply hot air to the second drum 16.

As shown in FIG. 1, the first treatment device L includes a cabinet 2 for supporting the second cabinet 1, a drawer 3 provided in the cabinet 2 so as to be pulled out from the cabinet 2, and a receiving unit 4 and 5 provided in the drawer 3 for providing a laundry treatment space.

The cabinet 2 forms the external appearance of the first treatment device L. The cabinet 2 may be located on the second treatment device T. In some implementations, the cabinet 2 may be located under the second treatment device T.

In some implementations, the first treatment device L is located under the second treatment device T, as shown in FIG. 1, the height of the second treatment device door 11 is increased due to the first treatment device L, with the result that it is possible for the user to conveniently introduce laundry into the second treatment device T or to conveniently remove the laundry from the second treatment device T. In addition, it is possible to attenuate vibrate generated from the first treatment device L by virtue of the weight of the second treatment device T. Furthermore, it is possible to prevent the second treatment device T from being inclined to a direction in which the drawer 3 is pulled out, when pulling out the drawer 3, by virtue of the weight of the second treatment device T.

The cabinet 2 is provided with an open surface 21, through which the drawer 3 may be pulled out from the cabinet 2 or inserted into the cabinet 2. In some implementations, the open surface 21 may be provided in a direction in which the second treatment device door 11 is located (e.g. the front surface of the second treatment device T).

The drawer 3 includes a drawer body 31, the upper surface of which is open, and a drawer cover 35 provided at the open surface of the drawer body 31.

The drawer body 31 may be configured to have a hexahedral shape having an empty space defined therein. The drawer cover 35 is fixed to the drawer body 31 in order to form the upper surface of the drawer body 31.

A drawer panel 33 is provided at the front surface of the drawer body 31. The drawer panel 33 is a member for opening and closing the open surface 21 of the cabinet 2 and, in addition, for pulling out the drawer body 31 from the cabinet 2 or inserting the drawer body 31 into the cabinet 2. The drawer panel 33 may be separably coupled to the drawer body 31.

The drawer panel 33 may be provided with a control panel 331 for controlling the operation of the first treatment device L. The control panel 331 is provided to allow the user to input a control command that may be necessary to control components (a water supply unit and a drainage unit) for supplying wash water to the receiving unit 4 and 5 and discharging wash water from the receiving unit 4 and 5, a component (a driving unit) for rotating laundry, and components (a hot air supply device and a moisture supply device) for supplying hot air and steam to laundry.

In addition, the control panel 331 may be provided with an input unit 332 for allowing the user to input a control command to the first treatment device L and a display unit 333 for allowing the user to confirm the control command input through the input unit 332 or notifying the user of the progress of execution of the control command input by the user. That is, the display unit 333 may display information about the operation of the first treatment device L.

The drawer cover 35 may be provided with an introduction port 353 formed through the drawer cover 35 for allowing the interior of the drawer body 31 and the exterior of the drawer body 31 to communicate with each other and a water supply port 355 formed through the drawer cover 35 for guiding wash water to the receiving unit 4 and 5.

As shown in FIG. 2, the receiving unit 4 and 5, which is provided in the drawer 3, may include a tub 4 provided in the drawer body 31 for providing a wash water receiving space and a drum 5 rotatably provided in the tub 4 for receiving laundry.

The tub 4 is fixed to the drawer 3 via a tub support unit 48. The tub support unit 48 connects the tub 4 and the drawer 3 to each other such that the circumferential surface of the tub 4 is supported by the drawer 3. The tub support unit 48 may be provided with a member for attenuating vibration.

A door 49 for allowing the interior of the tub 4 and the exterior of the tub 4 to communicate with each other is provided at the upper surface of the tub 4.

The door 49 is rotatably provided at the upper surface of the tub 4 (e.g. the door 49 is provided in order to open and close a portion of the upper surface of the tub 4). The door 49 may be pulled out from the drawer 3 (for example, by hinge rotation) through the introduction port 353, which is provided in the drawer cover 35. After pulling out the drawer 3 from the cabinet 2, therefore, the user may open the door 49 in order to introduce laundry into the tub 4.

The tub 4 is provided in the upper surface thereof with an inlet port 47, through which wash water supplied through the water supply port 355, provided in the drawer 3, is introduced into the tub 4. A pipe for connecting the water supply port 355 to the upper surface of the tub 4 may be provided as the inlet port 47. In some implementations, a hole formed through the upper surface of the tub 4, the hole being located under the water supply port 355, may be provided as the inlet port 47.

The drum 5 may be configured to have the shape of a cylinder, the upper surface of which is open. The drum 5 may be rotated in the tub 4 by a driving unit 6, which is provided outside the tub 4.

The driving unit 6 may include a stator 61 fixed to the tub 4 for generating a rotating magnetic field and a rotor 63 configured to be rotated by the rotating magnetic field. A driving shaft 53, which is fixed to the bottom surface of the drum 5 through the tub 4, is connected to the rotor 63.

As shown in the figure, the driving shaft 53 may be provided so as to be perpendicular to the bottom surface of the drawer 3.

Drum through holes 51 for allowing the interior of the drum 5 and the interior of the tub 4 to communicate with each other are provided in the outer circumferential surface of the drum 5.

As described above, the receiving unit includes the tub 4 and the drum 5 such that the first treatment device L is capable of performing a washing function. In addition, a hot air supply device for supplying hot air to the tub 4 may be further provided in the cabinet 2 such that the first treatment device L is also capable of performing a drying function.

The hot air supply device provided in the first treatment device L may be identical to the second hot air supply device, which was previously described, and therefore a detailed description thereof will be omitted.

In some implementations, the first treatment device L is configured only to dry laundry, and the receiving unit may include only the drum 5, and the hot air supply device provided in the first treatment device L may be configured to supply hot air to the drum 5.

The first treatment device L is connected via a water supply unit 7 to a water source located outside the laundry treatment apparatus 100. The water supply unit 7 may include a water supply pipe 71 for connecting the water supply port 355 to the water source and a valve 73 for opening and closing the water supply pipe 71 under the control of a controller.

Wash water received in the tub 4 is discharged out of the cabinet 2 through a drainage unit 8. The drainage unit 8 may include a drainage pipe 83 for guiding the wash water in the tub 4 out of the cabinet 2 and a pump 81 provided in the drainage pipe 83 for discharging the wash water from the tub 4 (under the control of the controller).

The driving unit 6 is fixed to the tub 4, and the tub 4 is fixed to the drawer 3 via the tub support unit 48. In the first treatment device L with the above-stated construction, therefore, vibration generated from the drum 5 or the tub 4 when the drum 5 is rotated by the driving unit 6 may be transmitted to the drawer 3.

When the vibration generated from the drum 5 or the tub 4 due to the operation of the driving unit 6 is transmitted to the drawer 3, the drawer 3 may collide with the cabinet 2, with the result that noise or vibration may be generated from the drawer 3 and the cabinet 2. Furthermore, during the rotation of the driving unit 6, the drawer 3 may move out from the cabinet 2.

In order to solve this problem, the laundry treatment apparatus 100 further includes an attachment and detachment unit 9 for fixing the drawer 3 to the cabinet 2 during the operation of the driving unit 6.

That is, the attachment and detachment unit 9 fixes the drawer 3 to the cabinet 2 in response to a signal from a controller 37, unlike a member, such as a handle, for separating the drawer 3 from the cabinet when external force is applied by the user.

FIG. 3 is a view schematically showing a structure in which the drawer 3, excluding the drawer cover 35, and the cabinet 2 are coupled to each other.

As shown in FIG. 3, the attachment and detachment unit 9 may include a first fastening unit 95 provided at the cabinet 2 and a second fastening unit 91 provided at the drawer 3 such that the second fastening unit 91 is coupled to the first fastening unit 95 according to a control signal from the controller 37.

The second fastening unit 91 may include a second fastening unit body 911 fixed to the drawer 3, a plunger 915 provided in the second fastening unit body 911 such that the plunger 915 can move out from the second fastening unit body 911, the plunger 915 being configured to be coupled to the first fastening unit 95, an elastic support unit 917 for pushing the plunger 915 in a direction in which the plunger 915 moves out from the second fastening unit body 911, and a coil 913 for moving the plunger 915 into the second fastening unit body 911 based on whether current is supplied to the coil 913. Current is supplied to the coil 913 via a switch 919, which is controlled by the controller 37.

The controller 37 may control the switch 919 not to supply current to the coil 913 (e.g. to maintain a state in which the second fastening unit is coupled to the first fastening unit) while the driving unit 6 is operating, and may control the switch 919 to supply current to the coil 913 (e.g. to maintain a state in which the second fastening unit is not coupled to the first fastening unit) while the driving unit 6 is not operating.

The second fastening unit 91 may be fixed to the drawer body 31 such that the second fastening unit 91 can be exposed outward when the drawer panel 33 is separated from the drawer body 31.

As previously described, the drawer panel 33 is a member for opening and closing the open surface 21 of the cabinet 2 and, in addition, for pulling out the drawer body 31 from the cabinet 2. The drawer panel 33 is separably coupled to the drawer body 31. Consequently, the drawer panel 33 is provided outside the cabinet 2 in an exposed state in order to form a surface facing the open surface 21 of the cabinet 2.

In some implementations, the second fastening unit 91 is configured so as to be exposed outside the cabinet 2 when the drawer panel 33 is separated from the drawer body 31, and therefore, it may be possible to inspect and repair the second fastening unit 91 without removing the drawer cover 35.

The first fastening unit 95 includes a support body 951 fixed to the cabinet 2 and a fastening hole 953 formed through the support body 951 such that the plunger 915 is inserted through the fastening hole 953.

However, the shape of the first fastening unit 95 is not particularly restricted so long as the plunger 915 can be coupled to the first fastening unit 95. For example, the first fastening unit 95 may include a support body 951 and a fastening recess formed in the support body 951.

Furthermore, the structure of the first fastening unit 95 may not be defined as shown in FIG. 3. That is, the first fastening unit 95 may include a fastening hole or a fastening recess provided in the inner circumferential surface of the cabinet 2 for allowing the plunger 915 to be inserted therein. In some implementations, the support body 951 of the first fastening unit 95 may be omitted.

In some implementations, the first treatment device L is configured to have a structure in which the door 49, which is configured to be opened for the user to introduce laundry into the drum 5, is provided at the upper surface of the tub 4, and in which the driving unit 6, which rotates the drum 5, is provided at the bottom surface of the tub 4.

Since the driving shaft 53, which rotates the drum 5, is connected to the bottom surface of the drum 5 through the bottom surface of the tub 4, the fluctuation of the drum 5 (the change in distance between the outer circumferential surface of the drum and the inner circumferential surface of the tub), which is a main vibration source of the first treatment device L, may gradually increase from the bottom surface of the drum 5 to the upper end of the drum 5.

In consideration of the fact that the fluctuation of the drum 5 gradually increases from the bottom surface of the drum 5 to the upper end of the drum 5 in the structure of the first treatment device L, it is possible to effectively prevent the drawer 3 from vibrating in the cabinet 2 or to effectively prevent the drawer 3 from moving out from the cabinet 2 when the attachment and detachment unit 9 is located higher than the driving unit 6. Consequently, the attachment and detachment unit 9 may be located higher than the driving unit 6 on the basis of the bottom surface of the drawer 3 (see FIG. 2).

The attachment and detachment unit 9 may be provided to fix the upper surface of the drawer 3 to the upper surface of the cabinet 2. In some implementations, as shown in FIG. 3, the attachment and detachment unit 9 may be provided to fix each side surface of the drawer 3 to a corresponding side surface of the cabinet 2.

In some implementations, the first fastening unit 95 of the attachment and detachment unit 9 may be provided at the inner upper part of the cabinet 2, and the second fastening unit 91 of the attachment and detachment unit 9 may be provided at the drawer cover 35 (e.g. the upper surface of the drawer 3).

In some implementations (e.g., FIG. 3), the first fastening unit 95 may be provided at each side of the inner circumferential surface of the cabinet 2, and the second fastening unit 91 may be provided at each side surface of the drawer 3.

Since the tub support unit 48, provided in the first treatment device L, connects the outer circumferential surface of the tub 4 to the drawer 3, as shown in FIG. 3, the tub 4 may vibrate on a plane parallel to the bottom surface of the drawer 3 during the rotation of the drum 5.

When the tub 4 vibrates on the plane parallel to the bottom surface of the drawer 3, force applied to one selected from between the left side surface and the right side surface of the drawer 3 may different from force applied to the other selected from between the left side surface and the right side surface of the drawer 3 depending on the form of the vibration.

In some implementations, the first fastening unit 95 is provided at each side of the inner circumferential surface of the cabinet 2, and the second fastening unit 91 is provided at each side of the drawer 3, however, it is possible to effectively prevent the drawer 3 from moving out from the cabinet 2 when the tub 4 vibrates on the plane parallel to the bottom surface of the drawer 3.

Unlike the above description, the first fastening unit 95 may be provided at the cabinet 2, and the second fastening unit 91 may be provided at the drawer 3. In consideration of the fact that the second fastening unit 91 is operated under the control of the controller (37), which may be provided at the drawer 3, for controlling the display unit 333 as well as the driving unit 6, the second fastening unit 91 may be provided at the drawer 3, and the first fastening unit 95 may be provided at the cabinet 2.

In addition, the height of the attachment and detachment unit located at one side surface (for example, the left side surface) of the drawer 3 and the height of the attachment and detachment unit located at the other side surface (for example, the right side surface) of the drawer 3 may be different from each other. In some implementations, each attachment and detachment unit 9 may be located higher than the driving unit 6.

The attachment and detachment unit 9 may be configured to couple the side front of the drawer body 31 to the cabinet 2, as previously described, rather than to couple the rear of the drawer body 31 to the cabinet 2

Most apparatuses have an assembly tolerance. The more complicated the structure of the apparatus is, the higher the assembly tolerance is. In the first treatment device L, the number of parts coupled to the front of the drawer body 31 is greater than the number of parts coupled to the rear of the drawer body 31.

That is, the drawer panel 31 is provided at the front of the drawer body 31, whereas the water supply unit 7 and the drainage unit 8 are provided at the rear of the drawer body 31. As a result, the sum of the assembly tolerances of the respective parts coupled to the rear of the drawer body 31 may be greater than the sum of the assembly tolerances of the respective parts coupled to the front of the drawer body 31.

The increase in sum of the assembly tolerances may cause a failure of coupling between two parts that are configured to be selectively coupled to each other. In order to overcome this problem, the attachment and detachment unit 9 may be located in front of the drawer 3 rather than behind the drawer 3. That is, the part 91 or 95 of the attachment and detachment unit 9 that is fixed to the drawer body 31 may be provided in the vicinity of a region where the drawer panel is fixed in a space provided by the drawer body 31.

FIG. 4 is a view an example in which the controller 37 controls the switch 919 to supply current to the coil 913 such that the plunger 915 is separated from the first fastening unit 95. When the plunger 915 of the second fastening unit 91 is separated from the first fastening unit 95, the user may pull out the drawer 3 from the cabinet 2.

The controller 37 may control the second fastening unit 91 not to be separated from the first fastening unit 95 during the operation of the driving unit 6.

The subject matter described in this application provides a laundry treatment apparatus that is capable of washing or drying laundry using a receiving unit configured to be pulled out from a cabinet.

In addition, the subject matter described in this application provides a laundry treatment apparatus that is capable of minimizing vibration of a receiving unit in a cabinet while washing or drying laundry.

Furthermore, the subject matter described in this application provides a laundry treatment apparatus that is capable of preventing a receiving unit from moving out from a cabinet while washing or drying laundry.

The invention claimed is:

1. A laundry treatment apparatus comprising:
- a drawer;
- a cabinet that is configured to receive the drawer;
- a tub that is accommodated in the drawer and configured to store water;
- an introduction port that is located in an upper surface of the drawer;
- a drum that is located in the drawer, that is configured to communicate with the introduction port, and that defines a laundry receiving space;
- a driving shaft that is located at a bottom surface of the drum;
- a controller that is configured to control the driving unit; and
- an attachment and detachment unit that is configured to connect the drawer to the cabinet in response to a control signal from the controller and that is configured to separate the cabinet and the drawer in response to a current applied in response to the control signal from the controller.

2. The laundry treatment apparatus according to claim 1, wherein the attachment and detachment unit is located above the driving unit.

3. The laundry treatment apparatus according to claim 1, wherein the attachment and detachment unit comprises:
- a first fastening unit that is located at the cabinet; and
- a second fastening unit that is located at the drawer and that is configured to couple to the first fastening unit in response to the control signal from the controller.

4. The laundry treatment apparatus according to claim 3, wherein:
- the first fastening unit is located at an inner upper part of the cabinet, and
- the second fastening unit is located at an upper part of the drawer.

5. The laundry treatment apparatus according to claim 3, wherein:
- the first fastening unit is located at a side of an inner circumferential surface of the cabinet, and
- the second fastening unit is located at a side surface of the drawer.

6. The laundry treatment apparatus according to claim 4, wherein:
- an additional first fastening unit is located at the inner upper part of the cabinet, and
- an additional second fastening unit is located at the upper part of the drawer.

7. The laundry treatment apparatus according to claim 5, wherein:
- an additional first fastening unit is located at another side of the inner circumferential surface of the cabinet, and
- an additional second fastening unit is located at another side surface of the drawer.

8. The laundry treatment apparatus according to claim 5, wherein
- the first fastening unit is located at each side surface of the drawer and a corresponding side surface of the cabinet,
- the second fastening unit is located at the each side surface of the drawer, and
- a height of one of the first fastening unit and a height of an additional first fastening unit are different.

9. The laundry treatment apparatus according to claim 3, wherein:
- the cabinet comprises an open surface that is configured to withdraw the drawer,
- the drawer comprises:
  - a drawer body that defines a space that is configured to receive the drum; and
  - a drawer panel that is separably connected to the drawer body and that is configured to open and close the open surface, and
- the second fastening unit is connected to the drawer body and is visible based on the drawer panel being separated from the drawer body.

10. The laundry treatment apparatus according to claim 3, further comprising:
- a tub that is located in the drawer and that is configured to receive the drum; and
- a door that is located at an upper surface of the tub and that is configured provide access to the drum,
- wherein the driving unit comprises:
- a rotor that is connected to the driving shaft; and
- a stator that is located at a lower surface of the tub and that is configured to rotate the stator.

11. The laundry treatment apparatus according to claim 10, wherein the attachment and detachment unit is located above the driving unit.

12. The laundry treatment apparatus according to claim 11, wherein:
- the first fastening unit is located at a side of an inner circumferential surface of the cabinet, and
- the second fastening unit is located at a side surface of the drawer.

13. The laundry treatment apparatus according to claim 12, wherein:
- an additional first fastening unit is located at another side of the inner circumferential surface of the cabinet, and an additional second fastening unit is located at another side surface of the drawer.

14. The laundry treatment apparatus according to claim 11, wherein the second fastening unit comprises:

a second fastening unit body that is connected to the drawer;

a plunger that is located in the second fastening unit body and that is separately coupled to the first fastening unit;

an elastic support unit that is configured to couple the plunger to the first fastening unit by moving the plunger toward the first fastening unit; and a coil that is configured to separate the plunger from the first fastening unit in response to current being supplied to the coil.

15. The laundry treatment apparatus according to claim 14, wherein the plunger is configured to engage a support body of the first fastening unit.

16. The laundry treatment apparatus according to claim 14, wherein the support body defines a fastening hole that is configured to receive the plunger.

17. The laundry treatment apparatus according to claim 14, wherein the controller is configured to supply current to the coil.

18. The laundry treatment apparatus according to claim 11, wherein the second fastening unit comprises a relay.

19. The laundry treatment apparatus according to claim 18, wherein the relay is configured to connect the drawer to the cabinet in response to the control signal.

20. The laundry treatment apparatus according to claim 1, further comprising a switch that is configured to open and close in response to a switch control signal from the controller and that is electrically located between the controller and the attachment and detachment unit.

21. The laundry treatment apparatus according to claim 1, further comprising:

a water supply unit that includes a water supply pipe that is configured to connect the tub to the water source and that includes a valve that is configured to open and close the water supply pipe;

a driving unit that is configured to rotate the driving shaft;

a drainage unit that is included a drainage pipe for guiding the water in the tub out of the cabinet, and a pump provided in the drainage pipe for discharging the water from the tub, wherein the controller is configured to operate at least of one of the driving unit, the water supply valve, and the pump when the control unit detects that the attachment and detachment unit is in locking state.

* * * * *